United States Patent [19]

Regan

[11] 4,190,120

[45] Feb. 26, 1980

[54] MOVEABLE GUIDE STRUCTURE FOR A SUB-SEA DRILLING TEMPLATE

[75] Inventor: A. Michael Regan, Huntington Beach, Calif.

[73] Assignee: Regan Offshore International, Inc., Torrance, Calif.

[21] Appl. No.: 852,908

[22] Filed: Nov. 18, 1977

[51] Int. Cl.[2] ..... E21B 7/12

[52] U.S. Cl. ..... 175/7; 33/185 R; 173/43; 166/366

[58] Field of Search ..... 175/5, 7; 166/0.5, 0.6, 166/366, 362; 299/70; 173/32, 43; 33/185

[56] References Cited

U.S. PATENT DOCUMENTS

| | | | |
|---|---|---|---|
| 3,166,123 | 1/1965 | Watkins | 166/0.6 |
| 3,261,398 | 7/1966 | Haeber | 166/0.5 |
| 3,336,572 | 8/1967 | Paull et al. | 166/0.5 X |
| 3,536,135 | 10/1970 | Dozier | 166/0.5 |
| 3,542,125 | 11/1970 | Sizer | 166/0.6 |
| 3,633,667 | 1/1972 | Falkner, Jr. | 166/0.5 |
| 3,789,921 | 2/1974 | DeChassy et al. | 175/9 X |
| 3,895,677 | 7/1975 | Bokenkamp | 166/0.5 |
| 3,987,638 | 10/1976 | Burkhardt | 166/0.5 |
| 4,068,487 | 1/1978 | Pease et al. | 175/7 |

*Primary Examiner*—James A. Leppink
*Assistant Examiner*—Richard E. Favreau
*Attorney, Agent, or Firm*—Poms, Smith, Lande & Rose

[57] ABSTRACT

A sub-sea template and moveable guide structure assembly for conducting sub-sea drilling and production operations selectively between a plurality of adjacent sub-sea wells has a sub-sea well template having a plurality of template sections, each of these sections having a plurality of well bore guide means in laterally spaced series relative to the longitudinal extent of the template; tool guide means for guiding a sub-sea well tool into a well bore guide means; carriage means and means for movebly mounting the carriage means to the template, the carriage means moveably mounting the tool guide means on the template for relative movement therebetween.

Sonic alignment means associated with the moveable guide structure and a sub-sea well tool are provided for sensing a spatial relationship between the guide structure and the well tool as the well tool is lowered onto the guide structure.

35 Claims, 21 Drawing Figures

11
122
17a
121
17
15
16
16a
14

122
60a
60b
55
141
67
71
73
8
70
72
7
14

XII
141
55
58
67
66
84
35
7
8
122
-121-
70
71
14
XIII
XIII
73
XII
8
7
72
35
48
66
67
58
55
141

MOVEABLE GUIDE STRUCTURE FOR A SUB-SEA DRILLING TEMPLATE

BACKGROUND OF THE INVENTION

The present invention relates in general to sub-sea oil well drilling apparatus wherein a drilling template is positioned on a sea bottom surface to provide a stable reference surface for well drilling tools and other well-head assemblies which are lowered onto the template from a sea surface drilling platform or drilling ship. In particular, the present invention relates to apparatus for guiding the drilling tools and other well-head assemblies onto the template as the tool or assembly is lowered from a drilling platform or ship and landed on the template. Further, the present invention also relates to apparatus for selectively positioning the drilling tool or assembly relative to the template once the tool or assembly has been landed on the template.

Heretofore, sub-sea drilling templates have provided relatively few drilling sites for any given template. The drilling tools or well head assemblies have been lowered from the drilling platform or drilling ship on the end of a drill caseing and have been guided into position on the template by wire line guide cables affixed to the template and extending to the drilling platform or ship. To reposition the tool or well head assembly at another site on the template, the tool or assembly was raised to the surface and guided down another set of guide cables to the second drilling site.

These prior solutions to the problem of multiple well production installations have resulted in production time losses due to the excessive vertical distances through which the tool or well head assembly must be moved in order to effect a relatively small lateral displacement at the template.

Additionally, the presence of a multitude of guide cables extending from the template to the surface clutters the sea zone between the template and the drilling platform or ship and increases the difficulty of disconnecting a drilling ship from the sub-sea installation during sever storms or other adverse circumstances.

SUMMARY OF THE INVENTION

It is therefore the primary object of the present invention to disclose and provide a sub-sea template and moveable guide structure assembly for conducting sub-sea drilling and production operations selective between a plurality of adjacent sub-sea wells.

It is a further object of the present invention to disclose and provide a sub-sea template and moveable guide structure assembly which will allow a drilling tool or well head assembly to be selectively repositioned relative to the template without raising the tool or assembly to the surface.

It is a further object of the present invention to disclose and provide a sub-sea template and moveable guide structure assembly wherein the wire line guide cables may optionally be disconnected from the template while, at the same time, not adversely affecting subsequent tool or well head assembly re-entry and landing operations.

It is a further object of the present invention to disclose and provide a sub-sea template and moveable guide structure assembly which entirely eliminates the use of wire line guide cables to guide the drilling tools and well head assemblies onto the template.

It is a further object of the present invention to disclose and provide a sub-sea template and moveable guide structure assembly which allows the wells to be closely spaced relative to each other while, at the same time, not limiting the size and strength of the guide structure which aligns the drilling tool or well head assembly relative to the template.

Generally stated, the present invention in sub-sea template and moveable guide structure assemblies includes the provision of a sub-sea well template having a plurality of template sections arranged in a longitudinally extending array. Each of the template sections has a plurality of well bore guide means in laterally spaced series relative to the longitudinal extent of the template. Tool guide means are provided for guiding a sub-sea well bore guide means. Carriage means and means for moveably mounting the carriage means to the template are provided such that the carriage means moveably mounts the tool guide means on the template for movement along the longitudinal extent of the template. Thus, the tool guide means may be selectively positioned with regard to selected ones of the template sections.

The carriage means of the present invention includes the provision of a carriage structure laterally spanning the template and moveable longitudinally along the template. A dolly structure having means for engaging the tool guide means is mounted on the carriage structure for movement laterally of the template in order that the tool guide means may be positioned with selected ones of the well bore guide means of any selected one of the template sections.

Motive means are provided for selectively moving the carriage structure relative to the template and for moving the dolly structure relative to the carriage structure, the motive means of the present invention being operable from a location remote from the drilling template.

Additionally, the sub-sea template and moveable guide structure assembly of the present invention may comprise sonic alignment means associated with the guide structure and the drilling tool or well head assembly for sensing a spatial relationship between the guide structure and the tool or assembly as the tool or assembly is lowered onto the guide structure. Landing control means associated with a sea surface drilling platform or drilling ship direct the landing movement of the drilling tool or well head assembly onto the guide structure in response to the spatial relationship therebetween as sensed by the sonic alignment means.

A more complete understanding of the improvements in sub-sea template and moveable guide structure assemblies in accordance wih the present invention, as well as a recognition of additional objects and advantages therefor, will be afforded to those skilled in the art from a consideration of the following detailed description of an exemplary embodiment thereof. Reference will be made to the appended sheets of drawings which will first be discussed briefly.

DETAILED DESCRIPTION OF AN EXEMPLARY EMBODIMENT

Figure 1:
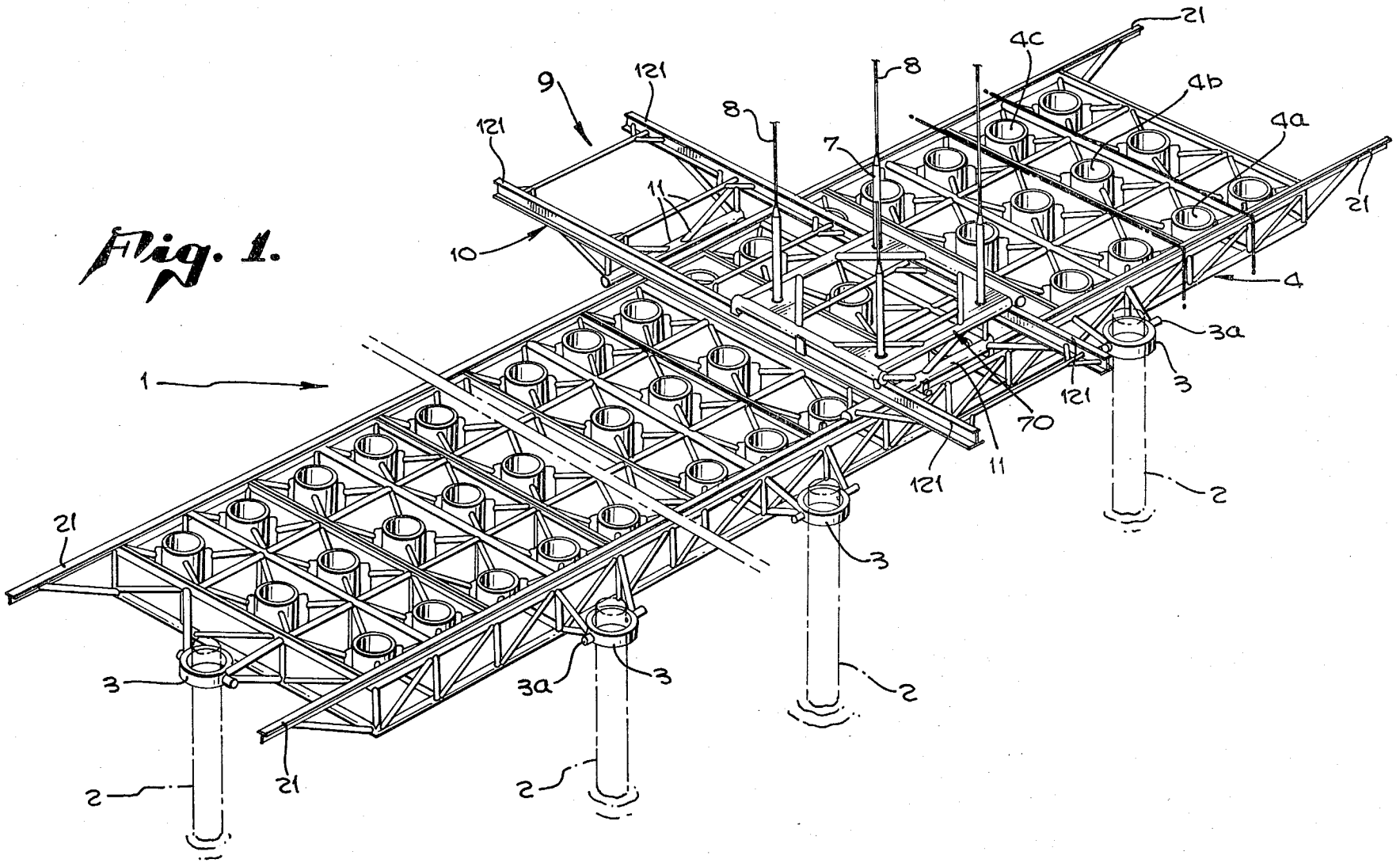
FIG. 1 is a perspective view showing the sub-sea template and moveable guide structure of the present invention.

Referring first to FIG. 1, a sub-sea template and moveable guide structure assembly for conducting sub-sea drilling and production operations selectively between a plurality of adjacent sub-sea wells is shown. A sub-sea well template shown at 1 has a plurality of template sections 4 arranged in a longitudily extending array. Each of the template sections 4 had a plurality of well bore guide means 4A/4B/4C in a laterally spaced series relative to the longitudinal extent of template 1.

Template 1 is secured in position relative to the sea bottom by running anchor piles 2 and securing mounting collars 3 to the anchor piles 2 by means of pin members 3*a* associated with mounting collars 3. Pin members 3*a* are driven through anchor piles 2 when the mounting collars are in a desired position on the respective anchor pile to prevent the collar from sliding along the anchor pile once the template has been leveled, as may be more clearly visualized from a consideration of FIGS. 1 and 2.

Tool guide means shown in the exemplary embodiment of FIG. 1 as guide posts 7 and wire line guide cables 8 are provided for guiding a sub-sea well tool or well head assembly 6 into a selected 1 of the well bore guide means 4A/4B/4C.

Carriage means and means for moveably mounting the carriage means to template 1 are provided. Carriage means shown generally at 9 in FIG. 1 moveably mount the tool guide means on template 1 for movement along the longitudinal extent thereof.

As best seen in FIG. 1, carriage means 9 comprises a plurality of superposed interconnected sub-structures mounted to template 1. A carriage structure 10 laterally spans template 1 and is moveable longitudinally along the template. A dolly structure 70 having means for engaging the tool guide means is moveably mounted on carriage structure 10 for movement laterally of template 1 and may be positioned with selected ones of well bore guide means 4A/4B/4C of selected ones of template sections 4.

Figures 5, 6, 7:
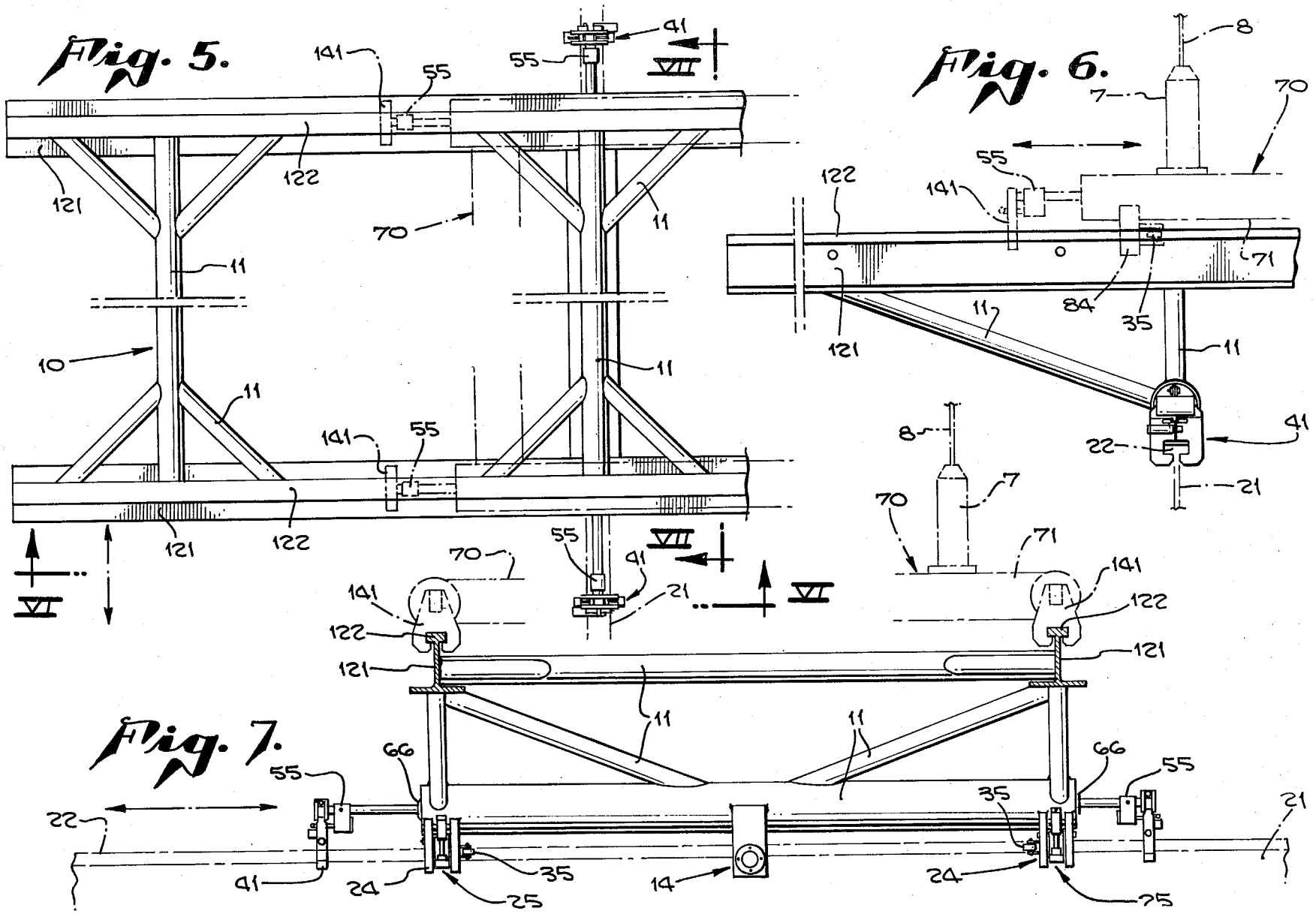
FIG. 5 is a partial plan view showing the moveable guide structure carriage means of the present invention.
FIG. 6 is a view of the moveable guide structure carriage means of the present invention through the plane VI—VI of FIG. 5.
FIG. 7 is a view of the moveable guide structure carriage means of the present invention taken through the plane VII—VII of FIG. 5.

Mounting means are provided for moveably mounting carriage means 9 to template 1 and comprise guide unit means having guide rail means 21 associated with template 1 and cooperating follower means associated with carriage structure 10. The rail follower means moveably engage rail means 21 and guide carriage means 10 longitudinally along rail means 21. As shown in FIGS. 6 and 7, and as shown in detail in FIGS. 8 and 9, the guide units comprise interlocking rail means 21 and rail follower means indicated generally at 24 such that relative movement between rail means 21 and rail follower means 24 is limited to reciprocal movement longitudinally along rail means 21.

Referring now to FIGS. 5, 6, and 7, if carriage structure 10 is considered to be a primary sub-assembly of carriage means 9 and, if dolly structure 70 is considered to be a secondary sub-assembly of carriage means 9, it should be noted that primary guide means interconnect carriage structure 10 and template 1, while secondary guide means interconnect dolly structure 70 with carriage structure 10.

Figure 8:
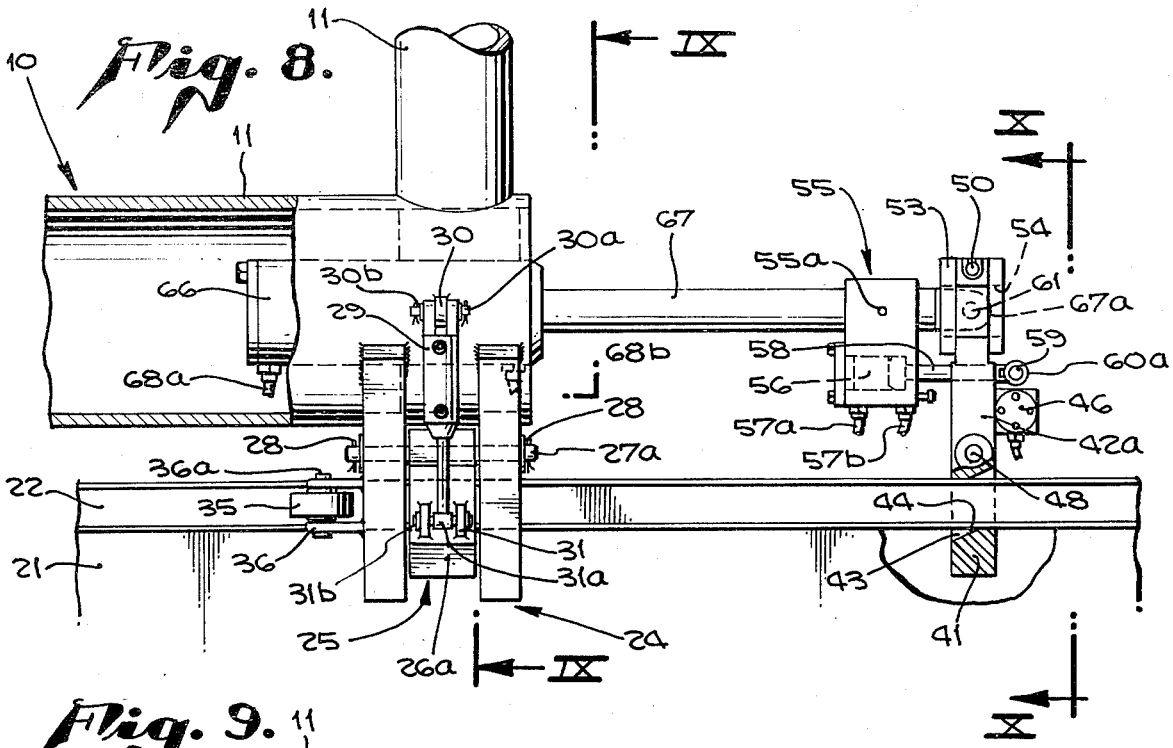
FIG. 8 is a detail view showing the primary motive means of the present invention.
Figure 9:
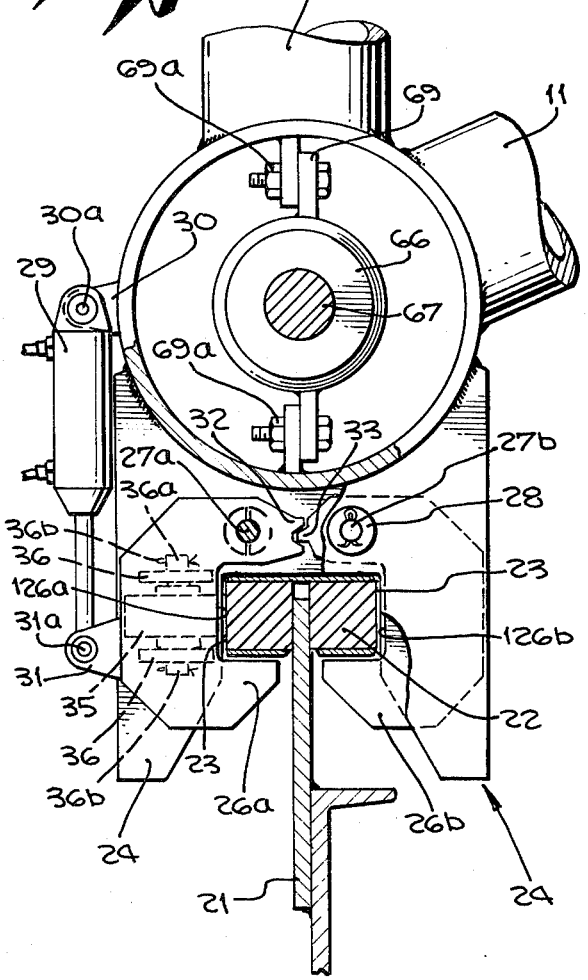
FIG. 9 is a view through the plane IX—IX of FIG. 8 showing in detail the latch means for releaseably securing the carriage means of the present invention to the template.
Figure 10:
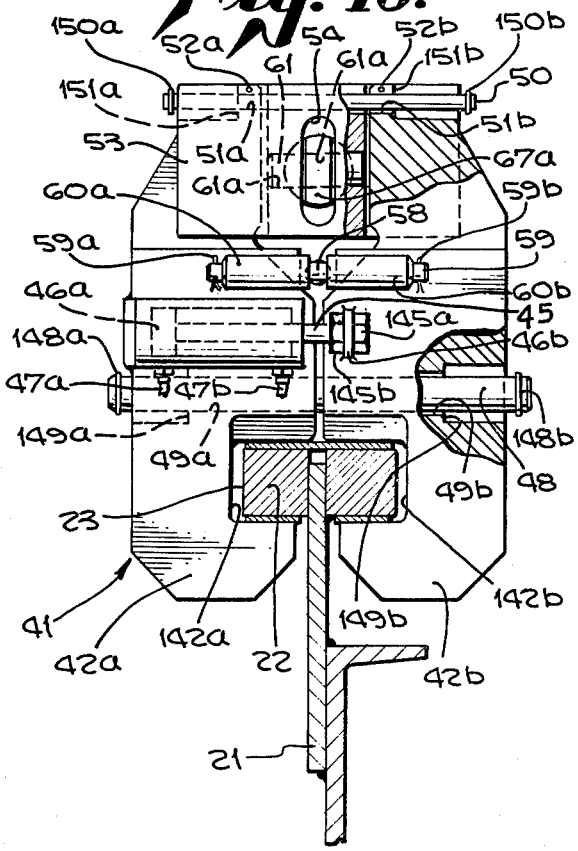
FIG. 10 is a partial sectional view through the plane X—X of FIG. 8 showing in detail the sliding lock means associated with the primary motive means of the present invention which releaseably engage the drilling template.

As best shown in FIGS. 8, 9, and 10, the primary guide means which interconnect carriage structure 10 and template 1 comprise primary rail means 21 associated with template 1 which support carriage means 9 relative to template 1. Primary rail follower means indicated generally at 24 which are associated with carriage structure 10 moveably engage primary rail means 21 and guide carriage structure 10 longitudinally along primary rail means 21.

Primary rail follower means 24 additionally comprises latch means 25 associated with carriage structure 10 for releasably engaging primary rail means 21 in a slidable interconnection and latching carriage structure 10 to primary rail means 21 subsequent to lowering carriage means 9 onto template 1. Latch means 25 comprises paired opposing caliper blocks 26*a* and 26*b* which are pivotally mounted relative to carriage structure 10 on pivot shafts 27*a* and 27*b* respectively which extend through apertures 127*a* and 127*b* on rail follower means 24 and are retained therein by any known shaft retained means such as Cotter keys 28, as best shown in FIG. 8. Caliper blocks 26*a* and 26*b* have cooperating opposing recess portions 126*a* and 126*b* respectively therein for receiving rail flange portions 22 of primary rail means 21 when latch means 25 is in a latched position on primary rail means 21, as in particularly shown in FIG. 9. As may be clearly seen from a consideration of FIG. 9, caliper blocks 26*a* and 26*b* and rail flange portions 22 of primary rail means 21 interlock such that relative movement therebetween is limited to a reciprocal longitudinal movement along primary rail means 21 when latch means 25 is in a latched position.

Operating means associated with latch means 25 selectively latch and release latch means 25. Means associated with the first one of paired opposing caliper blocks 26*a* and 26*b* pivot the block relative to carriage structure 10 and means operationally interconnecting paired opposing caliper blocks 26*a* and 26*b* pivot the second one of the blocks in response to the pivoting of the first block.

In the exemplary embodiment in operating means shown in means FIGS. 8 and 9, a hydraulic cylinder 29 is pivotally mounted between flange 30, mounting shaft 30*a* and cotter keys 30*b* associated with tubular frame member 11 of carriage structure 10 at the one end, and mounting flange 31, mounting shaft 31*a* and cotter keys 31*b* associated with caliper block 26*a* on the other end. As the effective length of hydraulic cylinder cylinder 29 is shortened from the position shown in FIGS. 8 and 9, caliper block 26*a* is pivoted generally clockwise, as viewed in FIG. 9, relative to carriage structure 10 about pivot shaft 27*a*. Gear means 32 associated with caliper block 26*a* meshes with and drives gear means 33 which is associated with caliper block 26*b*. Caliper block 26*b* is rotated counter-clockwise relative to carriage structure 10 about pivot shaft 27*b* in response to the pivoting of caliper block 26*a* which is being operated by hydraulic cylinder 29. In thus rotating caliper blocks 26*a* and 26*b* generally away from each other, opposing recessed portions 126*a* and 126*b* are also rotated generally away from each other into an unlatched position and rail flange portions 22 no longer interlock with caliper blocks 26*a* and 26*b*. In this unlatched configuration, carriage means 9 may be lifted entirely away from primary rail means 21 and relative movement between carriage structure 10 and primary rail means 21 is no longer limited to reciprocal movement longitudinally along rail means 21.

Figure 14:
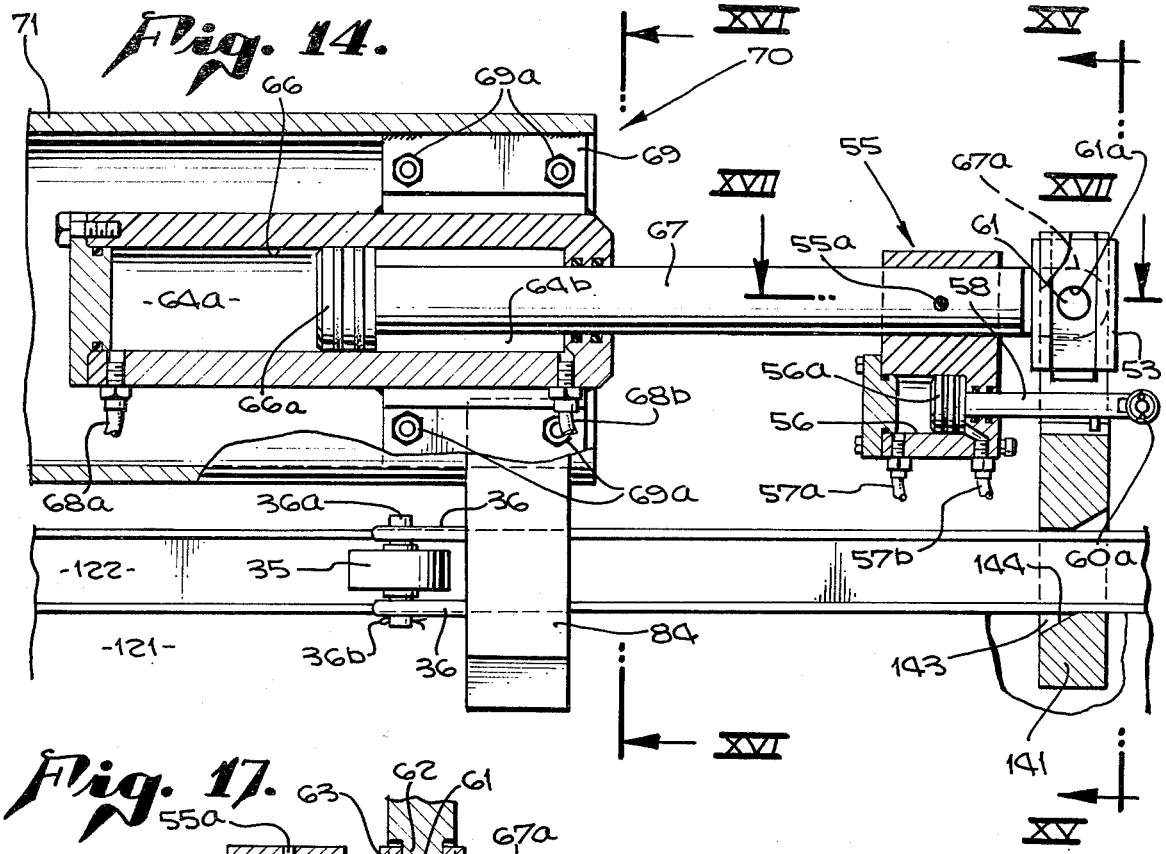
FIG. 14 is a partial sectional view showing in detail the motive means of the present invention enlarged from area shown in FIG. 7.
Figure 16:
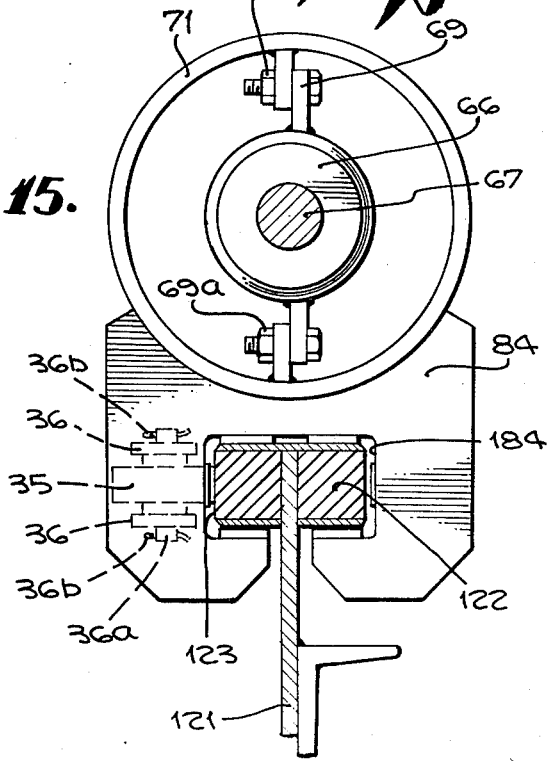
FIG. 16 is a view through the plane XVI—XVI of FIG. 14.
Figure 15:
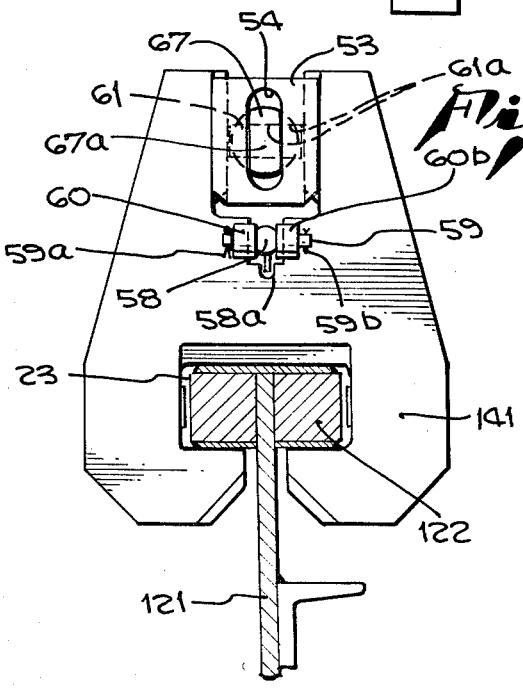
FIG. 15 is a detail view through the plane XV—XV of FIG. 14 showing the sliding lock means of the present invention.

Contrary to the operation of the primary guide means shown in FIGS. 8, 9, and 10, the secondary guide means of the present invention which interconnect dolly structure 70 and carriage structure 10 may not be unlatched to separate the dolly structure from the carriage structure. As best seen in FIGS. 14, 15, and 16, the secondary guide means which interconnect dolly structure 70 and carriage structure 10 has secondary rail follower means 84 which interlock with secondary rail means 121 such that relative movement there between is limited to reciprocal movement longitudinally along rail means 121. Secondary rail flange portion 122 is received within "T-Shaped" recess portion 184 of secondary rail follower means 84 to provide the interlocking interaction as is best seen in FIG. 16.

It should be noted from a consideration of FIGS. 8, 9, 14 and 15 that, in addition to the interlocking interaction between the recessed portions of the rail follower means and the flange protions of the rail means, the rail follower means of both the primary guide means and the secondary guide means comprise the additional provision of roller means shown generally at 35 in FIGS. 5, 6, 14 and 16. Roller means 35 are mounted to rail follower means 24 and 84 by means of mounting flanges 36 which support mounting shaft 36*a* which rotatably mounts roller means 35 to the rail follower means. Retaining cotter keys 36*b* retain mounting shaft 36*a* mounted to mounting flange 36. Roller means 35 contact lateral portions 23 of primary rail means 21 and lateral portion 123 of secondary rail means 121 and cooperate therewith to provide relative lateral positioning therebetween while minimizing friction during relative longitudinal movement therebetween. This lateral positioning function serves to prevent the rail means and rail follower means from binding during longitudinal movement of the rail follower means along the rail means.

Motive means are provided for moving carriage structure 10 relative to template 1 and for moving dolly structure 70 relative to carriage structure 10. Additionally, control means associated with the motive means are provided for regulating operation of the motive means from a location remote from the template. Exemplary of such remote location would be a surface drilling platform or drilling ship.

From a consideration of the exemplary embodiment of the present invention shown in FIGS. 1, 3, 4, 6 and 7, it may be seen that template 1 comprises an adjacent underlying structure with respect to carriage structure 10 and carriage 10 comprises an adjacent underlying structure with respect to dolly structure 70.

Sliding lock means 41 and 141 associated with carriage structure 10 and dolly structure 70 respectively are adjustable between locked and unlocked positions and are selectively slideable along a portion of the respective adjacent underlying structure when the sliding lock means is in an unlocked position. Each sliding lock means provides a fixed reference for its associated structure relative to its respective underlying structure when the sliding lock means is in a locked, non-slideable position relative to its respective underlying structure.

As best seen in FIGS. 8 and 14, sliding lock means 41 and 141 have recess means 43 and 143 respectively extending therethrough for receiving a cooperating portion of the underlying rail means. Fulcrum means 44 and 144 integral of recess means 43 and 143 wedge the cooperating rail means within the recess means and prevent relative movement therebetween when the sliding lock means is in a locked position as indicated in FIGS. 5 and 14.

If the motive means associated with carriage structure 10 for moving carriage structure 10 relative to template 1 are considered to be primary motive means and the motive means associated with dolly structure 70 for moving dolly structure 70 relative to carriage structure 10 are considered to be secondary motive means, it should be noted that the sliding lock means 41 associated with the primary motive means comprise the provision of latching means associated with the sliding lock means for releasably engaging a portion of primary rail means 21 which is associated with template 1. As best seen in FIG. 10, the latching means associated with the primary sliding lock means comprised provision of paired latching members 42*a* and 42*b* moveably mounted relative to each other and reversibly operatable between a latching position of engagement with primary rail means 21 and un latching position of disengagement with respect to primary rail means 21 such that, as has been previously discussed with respect to the primary guide means, as the latching means associated with the primary guide means and the primary motive means are unlatched, primary rail means 21 is no longer interlockingly engaged by these members and the carriage means of the present invention may be lifted out of engagement with sub-sea template drilling 1.

In operation, the exemplary embodiment of the present invention in latching means associated with primary sliding lock means 41 is actuated by operating rod 45 which extends from hydraulic piston and cylinder unit 46*a* which is associated with latching member 42*a* to mounting tab 46*b* which is associated with latching member 42*b*. Operating rod 45 is secured with respect to mounting tab 46*b* by means of fastening nuts 145*a* and 145*b*. Pressure lines 47*a* and 47*b* operate piston cylinder unit 46*a* in response to control signals from the drilling platform or drilling ship.

As actuator rod 45 is extended beyond piston cylinder unit 46*a*, latching member 42*b* is forced generally away from latching member 42*a*. Alignment rod 48 which extends through alignment bores 49*a* and 49*b* latching members 42*a* and 42*b* from binding on rail flange portions 42 as sliding lock means 41 is unlatched. Abutment shoulders 149*a* and 149*b* within alignment bores 49*a* and 49*b* respectively contact end caps 148*a* and 148*b* respectively which are secured to the end portions of alignment rod 48 and prevent latching members 42*a* and 42*b* from being forced completely off the ends of alignment rod 48. A supplemental alignment rod 50 is positioned within slot portions 51*a* and 51*b* at an upper end of latching members 42*a* and 42*b* respectively and is aligned generally parallel to alignment rod 48. End caps 150*a* and 150*b* are secured to alignment rod 50 and abut against abutment shoulders 151*a* and 151*b* to limit the movement of latching members 42*a* and 42*b* relative to supplemental alignment rod 50. As best seen in FIG. 10, retainer pins 52*a* and 52*b* prevent supplemental alignment rod 50 from being dislodged vertically out of slot portions 51*a* and 51*b* respectively.

When the latching means associated with sliding lock means 41 are in the unlatched position, latching members 42*a* and 42*b* are spaced apart from each other relative to primary rail means 21 such that recessed portions 142*a* and 142*b* within latching members 42 no longer interlockingly engage primary rail flange portions 22 of primary rail means 21 and sliding lock means 41 associated with primary motive means maybe be lifted vertically away from primary rail means 21.

The exemplary embodiment in sliding lock means associated with the secondary motive means of the present invention shown in FIG. 15 do not utilize latching means associated with sliding lock means 141. As with secondary rail follower means 84, the sliding lock means associated with the secondary motive means is provided with a "T-shaped" slot which receives and interlockingly engages secondary rail flange portions 122 of secondary rail means 121.

Actuator means indicated generally at 55 in FIGS. 8 and 14 adjust sliding lock means 41 and 141 between locked and unlocked positions.

Figure 17:
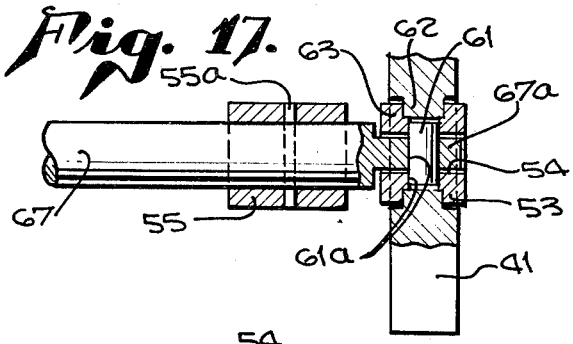
FIG. 17 is a detail view through the plane XVII—XVII of FIG. 14.

As best seen in FIGS. 14, 15, and 17 the sliding lock means are pivotally mounted relative to flattened end portion 67*a* of operating shaft 67. Mounting block 53 has an aperture 54 for receiving flatten end portion 67*a* and is connected thereto by cross-pinning pivot shaft 61 through aligned aperatures 61*a* which extend through both mounting block 53 and flattened end portion 67*a*. Mounting block 53, when thus first assembled to flatten end portions 67*a*, is assembled to a sliding lock means 41 or 141 by interlockingly engaging mortise 62 in mounting block 53 and tenon 63 of the sliding lock means, as most clearly shown in FIGS. 15 and 17.

Figure 20:
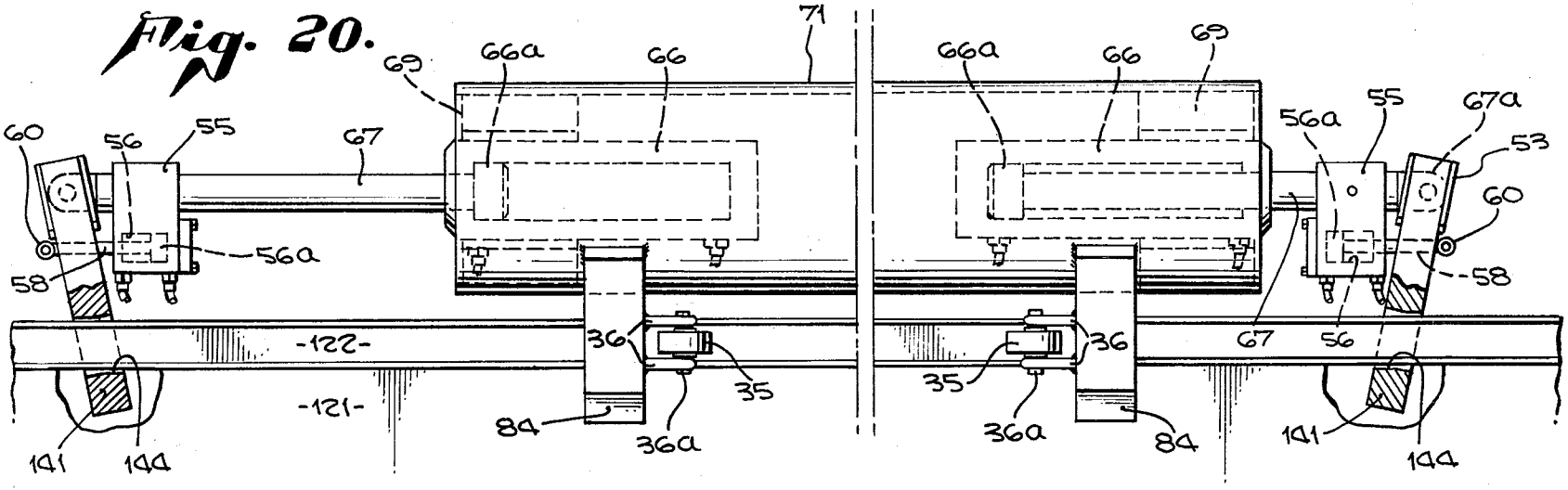
FIG. 20 is a schematic view showing the sliding lock means in an unlocked position prior to the movement thereof relative to the carriage.
Figure 21:
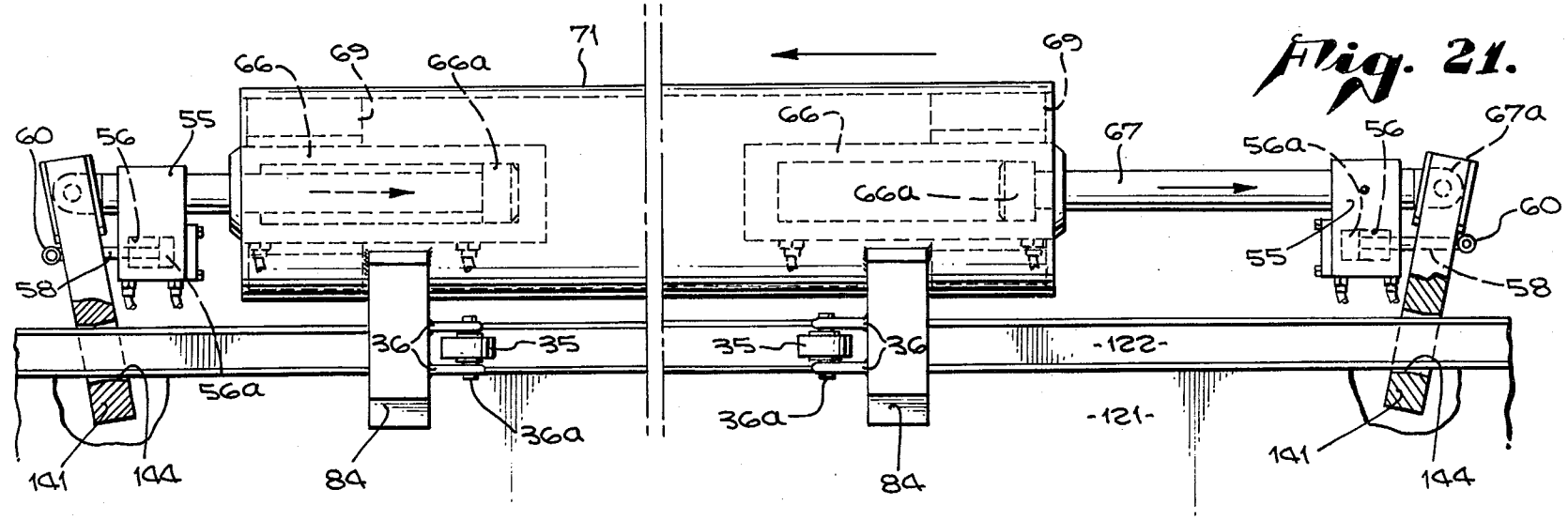
FIG. 21 shows the movement of the motive means of the present invention to the position shown in FIG. 18 prior to relocking the sliding lock means and recycling of the motive means.

Sliding lock means 41 and 141 are adjusted between a locked position relative to rail means 21, and 121 respectively as shown in FIG. 14, and an unlocked position, as shown in FIGS. 20 and 21, by operation of actuator means indicated generally at 55 in FIG. 14. Actuator means 55 comprises a hydraulic cylinder 56 and piston 56*a* which operate actuating rod 58 in response to pressure variations on opposite sides of piston 56*a*. The afore-mentioned pressure variations may be selectively controlled by means of hydraulic lines 57*a* and 57*b*. Actuating rod 58 extends through an aperature 58*a* in the sliding lock means and mounts a cross shaft 59 which is secured to actuating rod 58 by cotter keys 59*a* and 59*b* on an opposite side of the sliding lock means from actuator means 55. Rollers 60*a* and 60*b* are mounted on cross shaft 59 to prevent binding between cross shaft 59 and the sliding lock means as actuator means 55 adjusts the sliding lock means between locked and unlocked positions.

To unlock sliding lock means 41, and 141 piston 56*a* is moved from right to left as shown in FIG. 14 and rollers 60*a* and 60*b* are brought into contact with the surface of the sliding lock means. As the pressure through hydraulic line 57*b* is increased relative to the pressure through hydraulic line 57*a*, the piston continues to move from right to left and, in so doing, forces the sliding lock means to begin rotation about pivot shaft 61 in a generally clockwise direction until, as piston 56*a* reaches the left hand end of cylinder 56, the sliding lock means has been forced into the position shown in FIGS. 20 and 21.

In the unlocked position shown in FIGS. 20 and 21, exemplary fulcrum means 144 is moved out of contact with flange portions 122 of rail means 121 and the wedging action between sliding lock means 141 and rail means 121 within recess means 143 is discontinued. In this configuration, recess means 143 is wider than rail flange portions 122 and sliding lock means 141 may be freely moved longitudinally along rail means 121.

Sliding lock means 141 is retained in an unlatched position by rollers 60*a* and 60*b* during movement of sliding lock means 141 relative to rail means 121 by operating shaft 67. Once sliding lock means 141 is in a selected position relative to rail means 121, piston 56*a* is forced from left to right within cylinder 56 by increasing the pressure through hydraulic line 57*a* relative to the pressure in hydraulic line 57*b*. This will move rollers 56*a* and 56*b* out of contact with sliding lock means 141 and allow sliding lock means 141 to be rotated into the vertical position shown in FIG. 14 by a slight withdrawal of operating shaft 67 from right to left as shown in FIG. 14 and as will occur during the operation of the means for providing relative movement between sliding lock means 141 and an associated structure as will now be discussed.

As best seen in the exemplary embodiment shown in FIG. 14, operating shaft 67 interconnects sliding lock means 141 with piston 66*a* which is bi-directionally moveable within hydraulic cylinder 66 in response to pressure differentials on opposite sides of piston 66*a* which are regulated by means of hydraulic lines 68*a* and 68*b*. Once rollers 60*a* and 60*b* are moved out of contact with sliding lock means 141 by actuating rod 58, sliding lock means 141 is relatively freely rotatable about pivot shaft 61. By increasing the pressure in chamber 64*b* relative to pressure in chamber 64*a*, piston 66*a* will be moved generally from right to left in FIG. 14. As piston 56*a* and operating shaft 67 connected thereto move generally from right to left in FIG. 14, sliding lock means 141 will be urged into the vertical position shown in FIG. 14. At this time, guide rail means 121 will be wedged within recess 143 by fulcrum means 144 and sliding lock provide a fixed reference for the associated structure, in this case dolly structure 70, relative to underlying guide rail 121 which is associated with carriage structure 10. As the pressure within chamber 64*b* continues to increase, dolly structure 70 will be urged generally from left to right in FIG. 14 and thus will be moved relative to sliding lock means 141 and guide rail means 121 which is associated with underlying carriage structure 10.

Figures 11, 12, 13:
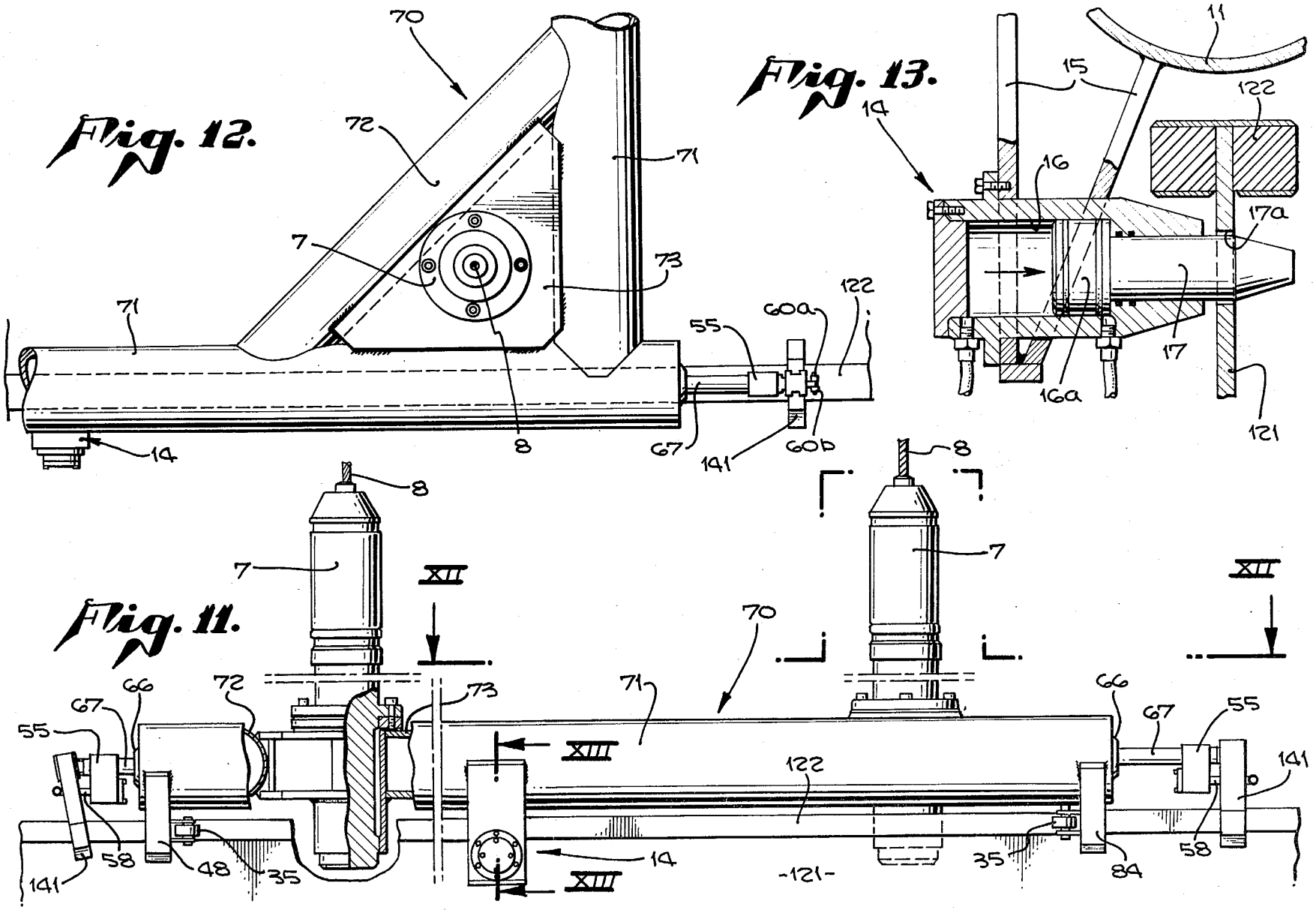
FIG. 11 is a side view showing the dolly structure mounted on the carriage structure and the motive means for moving the dolly structure relative to the carriage structure.
FIG. 12 is a plan view through the plane XII—XII of FIG. 11.
FIG. 13 is a partial sectional view through the plane XIII—XIII of FIG. 11 showing in detail the locking means which prevent movement of the dolly structure relative to the carriage structure.

To secure carriage structure 10 relative to template 1 and dolly structure 70 relative to carriage structure 10, structure lock means shown generally at 14 in FIGS. 7, 11 and 13 are provided. As shown in detail in FIG. 13, structure lock means 14 is mounted to a tubular frame member 11 of the structure to be locked in place by means of mounting bracket 15. Hydraulic cylinder 16 and piston 16A operate lock pin 17 between position of engagement and disengagement with an appropriate one of a plurality of locking apertures 17A in guide rail means 21. When lock pin 17 engages an appropriate aperture 17A, the structure is locked into position relative to guide rail means 21 or 121 and the respective underlying structure. Hydraulic lines 18*a* and 18*b* supply cylinder 16.

Figure 18:
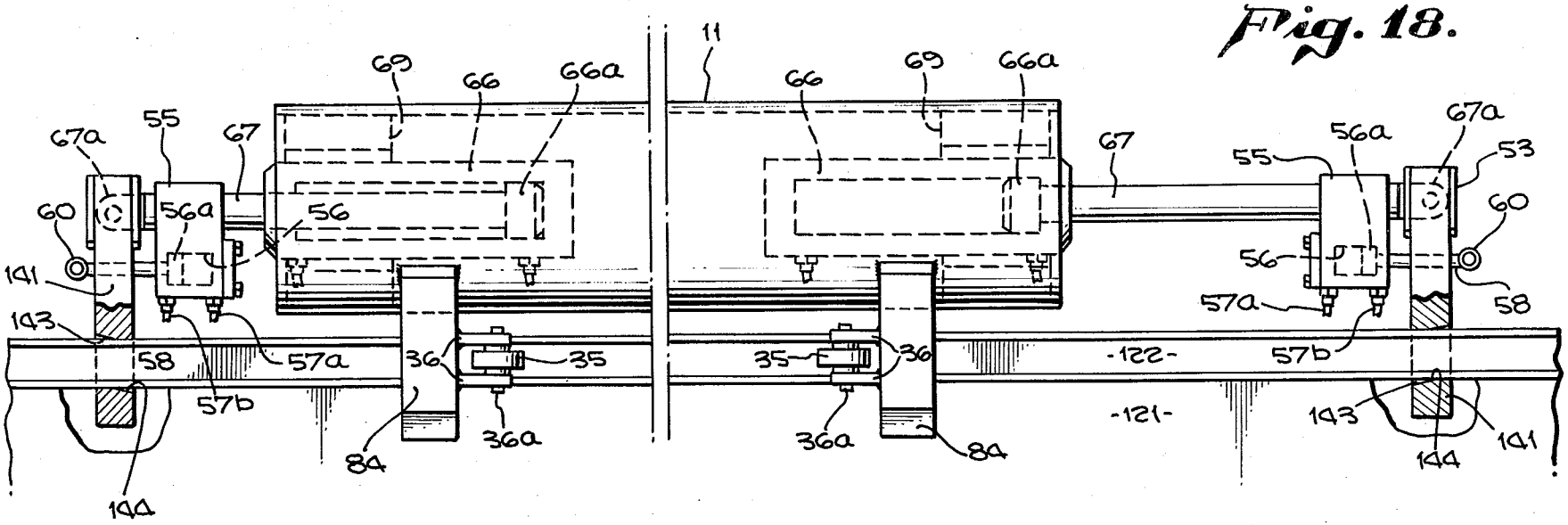
FIG. 18 is a schematic representation of the operation of the motive means of the present invention showing the sliding lock means in a locked position prior to movement of the carriage means.

The operational cycling of the motive means of the present invention will now be discussed. It should be noted that the motive means which cycle the carriage structure and the motive means which cycle the dolly structure operate in a similar manner. For the sake of brevity, the motive means associated with the dolly structure are specifically shown in FIGS. 18, 19, 20 and 21 and the discussion herein will relate to the dolly structure. It should be understood, however, that the discussion applies to the carriage structure motive means as well. The dolly structure and motive means associated therewith are shown in FIG. 18 immediately prior to the movement of the dolly structure from left to right relative to the underlying guide rail means 121. The sliding lock means 141 at each end of the dolly structure is in a vertical, locked position to provide fixed reference points for the dolly structure relative to the underlying guide rail means 121. Once these fixed reference points are established, the dolly structure is moved from right to left relatively between the fixed reference points established by the sliding lock means 141 to the position shown in FIG. 19 cylinder 66.

Figure 19:
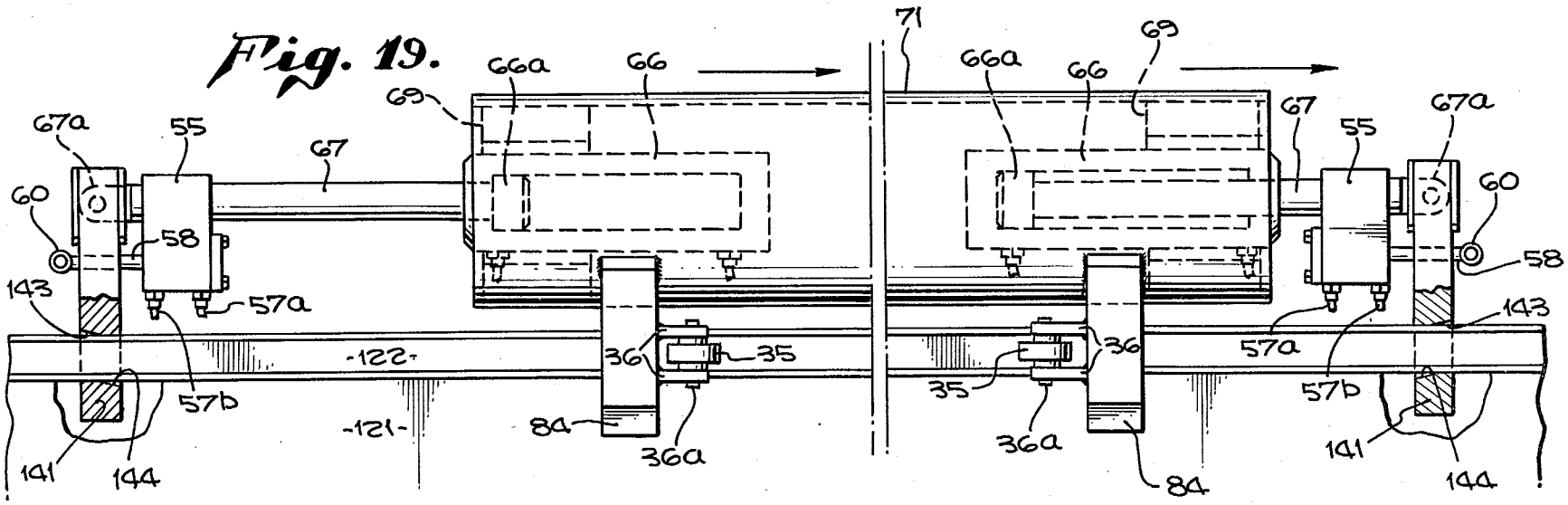
FIG. 19 is a schematic view showing the carriage being moved from left to right relative to the locked sliding lock means.

Once the dolly structure has reached the position shown in FIG. 19 the sliding lock means 141 are adjusted from locked position shown in FIG. 19 to the unlocked position shown in FIG. 20 by the operation of actuator means 55. In the unlocked position, the sliding lock means 141 may be slid along guide rail means 121 from the positions shown in FIG. 20 to the positions shown in FIG. 21 by the selective operation of pistons 66*a* within hydraulic cylinder 66.

Once the sliding lock means 141 have been repositioned relative to guide rail means 121, as shown in FIG. 21, actuator means 55 are operated such that, as pistons 66A are initially activated relative to hydraulic cylinder 66, the sliding lock means 141 are moved into the vertical, locked position relative to guide rail means 121, as shown in FIG. 18, and the operating cycle may be repeated until the dolly structure is in a desired position relative to underlying guide rail means 121 which is associated with carriage structure 10.

The moveable guide structure of the present invention is adaptable to conventional wire line guide cable apparatus for assisting in landing drilling tools and well head assemblies on the guide structure. As has been previously discussed, the drilling tool or well head assembly may be guided into position relative to dolly structure 70 by wire line guide cable shown at 8 in FIGS. 11 and 12. The wire line guide cables 8 guide the tool or assembly onto tool guides 7 which are secured to dolly structure 70 by mounting plates 73. In the exemplary embodiment shown, mounting plates 73 are welded between tubular frame members 71 and corner brace members 72 of the dolly structure. Once the tool or assembly has been lowered onto tool guides 7, cooperating sockets (not shown) associated with the drilling tool or well head assembly matingly engage tool guides 7 to retain the drilling or wellhead assembly in alignment relative to the dolly structure.

Additionally, the sub-sea template and moveable guide structure of the present invention may comprise the provision of sonic alignment means associated with the moveable guide structure and a drilling tool or well head assembly for sensing a spatial relationship between the moveable guide structure and the tool or assembly as the tool or assembly is lowered onto the guide structure. Landing control means associated with a sea surface drilling platform or drilling ship direct the drilling tool or well head assembly onto the movable guide structure of the present invention in response to a spatial relationship therebetween as sensed by the sonic alignment means.

The sonic alignment means of the present invention have sonic emitter associated with the drilling tool or wellhead assembly for emitting sonic vibrations at a selected frequency. Reflector means associated with the moveable guide structure of the present invention reflect the sonic vibrations which are in turn detected by sonic detector means tune to the same frequency as the sonic emitter.

Figure 3:
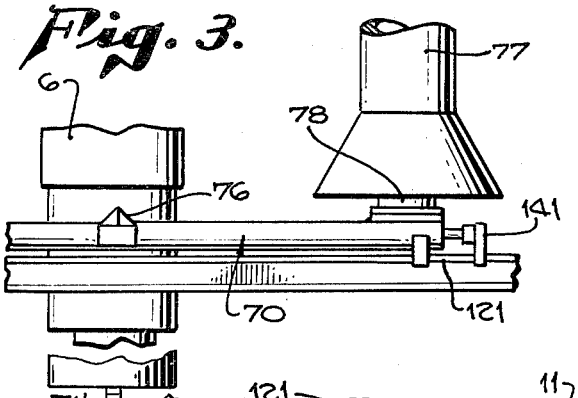
FIG. 3 is a side view taken through the plane III—III of FIG. 2 showing a well head assembly being positioned by the guide structure of the present invention.
Figure 4:
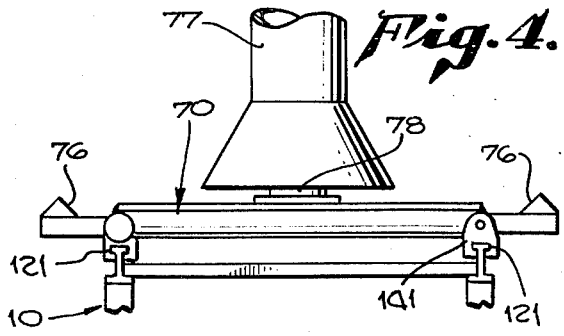
FIG. 4 is a view through the plane IV—IV of FIG. 2.
Figure 2:
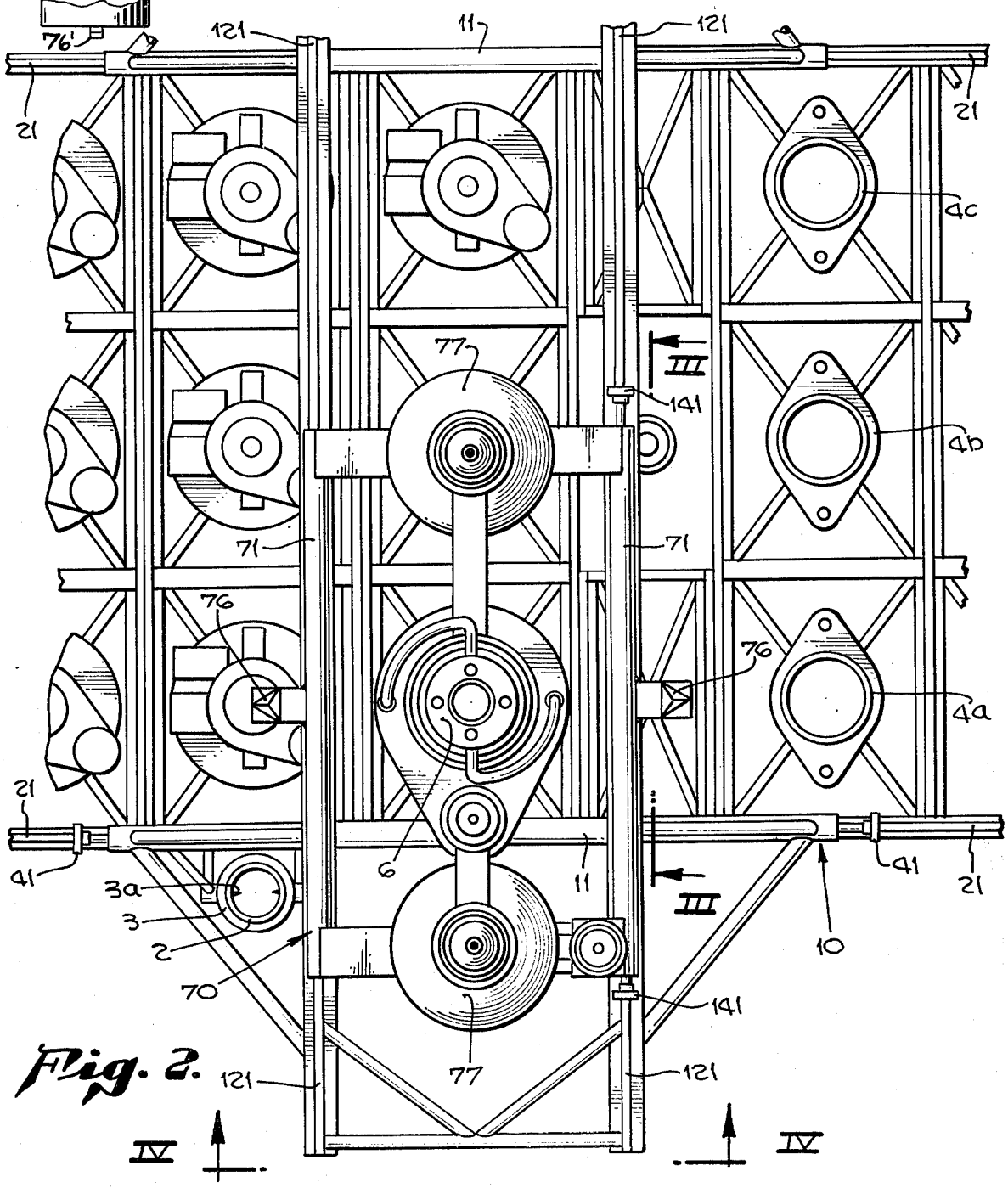
FIG. 2 is a plan view showing the sub-sea template and moveable guide structure of the present invention.

As may best be visualized from a consideration of FIG. 2, 3 and 4, once carriage structure 10 and dolly structure 70 are in position and aligned with a selected well bore guide means 4*a*/4*b*/4*c*, re-entry operations wherein various wellhead assemblies 6 and drilling tools are removed from, and replaced relative to, the desired well bore guide means may be guided by the surprisingly simple expedient of positioning sonic reflectors shown at 76 in FIGS. 2, 3 and 4 generally outboard of and aligned with dolly structure 70. Sonic reflector 76 are secured directly to dolly structure 70 and remain in place on the dolly structure at all times during drilling operations. The sonic reflectors 76 shown in the exemplary embodiment of FIGS. 2, 3, and 4 comprise pyramidal structures which permit a more accurate determination of the relative spatial relationship between the moveable guide structure on the sea bottom and the wellhead assembly or drilling tool which is being lowered onto the guide structure.

In re-entry and landing operations wherein wire line guide cables are not used for aligning the wellhead assembly or drilling tool, and as shown in the exemplary embodiment of FIGS. 2, 3, and 4, a sonic alignment means comprising a sonic emitter/sonic detector apparatus 76' is associated with the well head assembly 6 or drilling tool being lowered and as the emissions are reflected from sonic reflector 76, and detected by the sonic detector the initial alignment of the well head assembly or drilling tool being lowered by be achieved. Once the wellhead assembly or drilling tool is close proximity to the moveable guide structure of the present invention, two large guidance cones 77 which are lowered with the well head assembly or drilling tool are guided over two large alignment posts on the moveable guide structure of the present invention by the sonic alignment means and final alignment is achieved by mating inter-engagement of guidance cone 77 and guidance post 78.

Having thus described an exemplary embodiment of an improved subsea template and moveable guide structure for conducting sub-sea drilling and production operations selectively between a plurality of adjacent sub-sea wells, as well as various exemplary embodiments for re-entry and landing operation guidance, it should be understood by those skilled in the art the various alternatives and modifications thereof may be made within the scope and spirit of the present invention which is defined by the following claims.

I claim:

1. A subsea template and movable guide structure assembly for conducting subsea drilling and production operations selectively between a plurality of adjacent subsea wells comprising:

a subsea well template having a plurality of template sections arranged in a longitudinally extending array, each of said sections having a plurality of well bore guide means in laterally spaced series relative to the longitudinal extent of said template;

tool guide means for guiding a subsea well tool into a well bore guide means;

carriage means and means for movably mounting said carriage means to said template, said carriage means movably mounting said tool guide means on said template for movement along the longitudinal extent thereof, whereby, said tool guide means may be positioned with regard to selected ones of said sections.

2. The subsea template and movable guide structure assembly of claim 1, wherein said carriage means comprises the provision of locking means for preventing movement of said carriage means relative to said template once said tool guide means has been positioned with respect to a selected template section.

3. The subsea template and movable guide structure of claim 1 comprising the further provision of sonic alignment means for sensing a spatial relationship between said guide structure and a well head assembly as said well head assembly is lowered onto said guide structure, said sonic alignment means comprising:

sonic emitter/sonic detector means associated with said well head assembly for emitting sonic vibrations at a selected frequency;

reflector means associated with said guide structure for reflecting said sonic vibrations; whereby, as said well head assembly is lowered onto said guide structure during re-entry operations or the like, said well head is guided into position on said guide structure in response to said sonic emitter/means thereby obviating any need for wire line guide cables to guide said well head assembly onto said guide structure.

4. The subsea template and movable guide structure assembly of claim 1 wherein said carriage means comprises:

a carriage structure laterally spanning said template and movable longitudinally along said template;

a dolly structure having means for engaging said tool guide means;

means for movably mounting said dolly structure on said carriage structure for movement laterally of said template whereby said tool guide means may be positioned with selected ones of said well bore guide means of said selected ones of said sections.

5. The subsea template and movable guide structure assembly of claim 4 wherein said means for movably mounting said carriage means to said template and for movably mounting said dolly structure to said carriage structure comprise guide unit means having rail means associated with said template and said carriage structure and cooperating rail follower means associated with carriage structure and said dolly structure respectively, said rail follower means movably engaging said cooperating rail means for guiding said carriage structure and said dolly structure longitudinally along said respective rail means.

6. The subsea template and movable guide structure of claim 5 wherein said rail follower means comprises the additional provision of roller means for contacting lateral portions of said cooperating rail means to provide relative lateral positioning therebetween while minimizing friction during relative longitudinal movement therebetween.

7. The subsea template and movable guide structure of claim 5 wherein said guide units comprise interlocking rail means and rail follower means such that relative movement therebetween is limited to reciprocal movement longitudinally along said rail means.

8. The subsea template and movable guide structure of claim 3 comprising the provision of motive means for selectively moving said carriage structure relative to said template and for moving said dolly structure relative to said carriage structure.

9. The subsea template and movable guide structure of claim 8 wherein control means associated with said motive means are provided for regulating operation of said motive means from a location remote from said template.

10. The subsea template and movable guide structure of claim 8 wherein said template comprises an adjacent underlying structure with respect to said carriage structure, said carriage structure comprises an adjacent underlying structure with respect to said dolly structure and wherein said motive means comprises:

sliding lock means associated with said carriage structure and said dolly structure said sliding lock means being adjustable between locked and unlocked positions and selectively slidable along a portion of each said adjacent underlying structure respectively when said sliding lock means is in an unlocked position for providing a fixed reference for an associated structure relative to its respective underlying structure when said sliding lock means is in a locked, non-slidable position relative to said underlying structure;

actuator means for adjusting said sliding lock means between locked and unlocked positions;

means for providing relative movement between said sliding lock means and said associated such that when said sliding lock means is in an unlocked position, said sliding lock means may be slid along said portion of said underlying structure relative to said associated structure, and said associated structure may be moved relative to said sliding lock means and said underlying structure when said sliding lock means is in a locked position.

11. The subsea template and movable guide structure of claim 10 wherein said sliding lock means has recess means for receiving said cooperating rail means; and fulcrum means integral of said recess means for wedging said rail means within said recess means and preventing relative movement therebetween when said sliding lock means is in a locked position.

12. The subsea template and movable quide structure of claim 8 wherein said motive means comprises:

primary motive means associated with said carriage structure for moving said carriage structure relative to said template; and secondary motive means associated with said dolly structure for moving said dolly structure relative to said carriage structure.

13. The subsea template and movable guide structure of claim 12 wherein said primary motive means comprises:

latching means associated with said sliding lock means for releasably engaging said portion of said template; and operating means associated with said latching means for selectively latching and releasing said latch means.

14. The subsea template and movable guide structure of claim 13 wherein said latching means comprises:

paired latching members movably mounted relative to each other reversibly operable between a latching position of engagement and an unlatched position of disengagement with rail means associated with said subsea drilling template.

15. The subsea template and movable quide structure of claim 12 wherein primary guide means interconnect said carriage structure and said template, said primary guide means comprising:

primary rail means associated with said template for supporting said carriage means relative to said template; and primary rail follower means associated with said carriage structure for movably engaging said primary rail means and guiding said carriage structure longitudinally along said primary rail means.

16. The subsea template and movable guide structure of claim 15 wherein said primary rail follower means comprises:

latch means associated with said carriage structure for releasably engaging said primary rail means in a slidable interconnection and latching said carriage structure to said primary rail means subsequent to lowering said carriage means onto said primary rail means;

operating means associated with said latch means for selectively latching and releasing said latch means.

17. The subsea template and movable guide structure of claim 16 wherein said latch means comprises:

paired opposing caliper blocks pivotally mounted relative to said carriage structure and having cooperating opposing recess portions therein for receiving portions of said primary rail means when said latch means is in a latched position on said primary rail means.

18. The subsea template and movable guide structure of claim 17 wherein said caliper blocks and said portions of said primary rail means interlock such that relative movement therebetween is limited to reciprocal longitudinal movement along said primary rail means when said latch means is in a latched position.

19. The subsea template and movable guide structure of claim 17 wherein said operating means comprises:

means associating with a first one of said paired opposing caliper blocks for pivoting said block relative to said carriage structure; and means operationally interconnecting said paired opposing caliper blocks for pivoting a second one of said blocks in response to the pivoting of said first block.

20. The subsea template and movable guide structure of claim 19 wherein:

a hydraulic cylinder pivots said first block; and gear means associated with said first block mesh with the drive gear means associated with said second block.

21. An improved apparatus for positioning a well head Christmas tree relative to a generally planar, subsea drilling template comprising:

a plurality of superposed interconnected sub-assemblies mounted to said template and individually moveable relative to said template, said movement of each sub-assembly being restricted to reciprocal movement in a single plane and with each said plane being generally parallel to said planar template;

guide means for mounting said sub-assemblies relative to each other and relative to said template and for guiding said reciprocal movement of each sub-assembly generally at right angles relative to said reciprocal movement of adjacent sub-assemblies;

motive means for moving each said sub-assembly relative to an immediately adjacent underlying structure; and control means for regulating said reciprocal movement of each said sub-assembly from a location remote from said drilling template.

22. The apparatus of claim 21 wherein said guide means comprises a plurality of guide units having cooperating paired rail means and rail follower means associated with adjacent ones of said sub-assemblies, one guide unit being associated with said sub-sea drilling template and an immediately adjacent overlying sub-assembly, such that each said rail means supports an overlying sub-assembly and each said rail follower means moveably engages an underlying cooperating rail means mounted to an underlying structure and guides said associated overlying sub-assembly longitudinally along said rail means.

23. The apparatus of claim 22 wherein said guide units comprise interlocking rail means and rail follower means such that relative movement there between is limited to reciprocal movement longitudinally along said rail means.

24. The apparatus of claim 22 wherein said rail follower means comprises the additional provision of roller means for contacting lateral portions of an underlying cooperating rail means to provide relative lateral positioning therebetween while minimizing friction during relative longitudinal movement therebetween.

25. The apparatus of claim 22 wherein said motive means comprise:

sliding lock means adjustable between locked and unlocked positions and slideable along a portion of said underlying structure when said sliding lock means is in an unlocked position for providing a fixed reference for an associated sub-assembly relative to said underlying structure when said sliding lock means is in a locked, non-slideable position relative to said underlying structures;

acutator means for adjusting said sliding lock means between locked and unlocked positions; and means for providing relative movement between said sliding lock means and said associated sub-assembly such that when said sliding lock means is in an unlocked position, said sliding lock means may be slid along said portion of said underlying structure relative to said associated sub-assembly and said associated sub-assembly may be moved relative to said sliding lock means and said underlying structure when sliding lock means is in a locked position.

26. The apparatus of claim 25 wherein said sliding lock means has recess means for receiving said underlying rail means; and fulcrum means integral of said recess means for wedging said rail means within said recess means and preventing relative movement there between when said sliding lock means is in a locked position.

27. The apparatus of claim 25 wherein said motive means comprises:

primary motive means associated with a first sub-assembly immediately adjacent said template relative to others of said plurality of sub-assemblies for moving said first sub-assembly relative to said template;

secondary motive means associated with each subsequent sub-assembly for moving each said sub-assembly relative to an adjacent sub-assembly.

28. The apparatus of claim 27 wherein said primary motive means comprises:

latching means associated with said sliding lock means for releasably engaging said portion of said underlying structure; and operating means associated with said latching means for selectably latching and releasing said latch means.

29. The apparatus of claim 28 wherein said latching means comprises:

paired latching members moveably mounted relative to each other and operatable between positions of engagement and disengagement with rail means associated with said sub-sea drilling template; and hydraulic operating means for selectively operating said latching members between positions of engagement and disengagements with said rail means.

30. The apparatus of claim 25 wherein said first sub-assembly is a primary sub-assembly and wherein primary guide means interconnect said primary sub-assembly and said template, said primary guide means comprising:

primary rail means associated with said template for supporting said plurality of sub-assemblies relative to said template; and primary rail follower means associated with said primary sub-assembly for moveably engaging said rail means and guiding said primary sub-assembly longitudinally along said rail means.

31. The apparatus of claim 30 wherein said primary rail follower means comprises:

latch means associated with said primary sub-assembly for releasably engaging said primary rail means in a slideable interconnection and latching said primary sub-assembly to said primary rail means subsequent to lowering said primary sub-assembly onto said primary rail means; and operating means associating with said latch means for selectably latching and releasing said latch means.

32. The apparatus of claim 31 wherein said latch means comprises:

paired opposing caliper blocks pivotally mounted relative to said primary sub-assembly and having cooperating opposing recessed portions therein for receiving portions of said primary rail means when said latch means is in a latched position on said primary rail means.

33. The apparatus of claim 32 wherein said caliper blocks and said portions of said primary rail means interlock such that relative movement there between is limited to reciprocal longitudinal movement along said primary rail means when said latch means is in a latched position.

34. The apparatus of claim 32 wherein said operating means comprises:

means associating with a first one of said paired opposing caliper blocks for pivoting said block relative to said primary sub-assembly; and means operationally interconnecting said paired opposing caliper blocks for pivoting a second one of said blocks in response to the pivoting of said first block.

35. The apparatus of claim 34 wherein:

hydraulic cylinder means pivot said first block; and gear means associated with said first block mesh with and drive gear means associated with said second block.

* * * * *